US009271552B2

(12) United States Patent
Van Ostenbridge

(10) Patent No.: US 9,271,552 B2
(45) Date of Patent: Mar. 1, 2016

(54) SPORTS EQUIPMENT COLLECTION AND TRANSPORT DEVICE

(76) Inventor: Ronald Van Ostenbridge, Houston, TX (US)

( * ) Notice: Subject to any disclaimer, the term of this patent is extended or adjusted under 35 U.S.C. 154(b) by 500 days.

(21) Appl. No.: 13/205,761

(22) Filed: Aug. 9, 2011

(65) Prior Publication Data

US 2013/0037591 A1 Feb. 14, 2013

(51) Int. Cl.

| | |
|---|---|
| ***A63B 47/02*** | (2006.01) |
| ***A45C 3/00*** | (2006.01) |
| ***A45C 5/08*** | (2006.01) |
| ***A45C 5/14*** | (2006.01) |
| ***A45C 9/00*** | (2006.01) |
| ***A45C 13/00*** | (2006.01) |
| ***A45C 13/04*** | (2006.01) |
| ***A63B 47/00*** | (2006.01) |

(52) U.S. Cl.

CPC . *A45C 3/001* (2013.01); *A45C 3/00* (2013.01); *A45C 5/08* (2013.01); *A45C 5/14* (2013.01); *A45C 9/00* (2013.01); *A45C 13/005* (2013.01); *A45C 13/04* (2013.01); *A63B 47/00* (2013.01); *A63B 47/02* (2013.01); *A45C 2003/002* (2013.01); *A45C 2003/007* (2013.01)

(58) Field of Classification Search

USPC ..... 224/919, 607, 241; 383/33, 34, 117; 206/315.9; 150/120, 123, 124

See application file for complete search history.

(56) References Cited

U.S. PATENT DOCUMENTS

| | | | | |
|---|---|---|---|---|
| 1,925,295 | A * | 9/1933 | Whiting | 150/124 |
| 2,497,353 | A * | 2/1950 | Henke | 150/112 |
| 2,683,478 | A * | 7/1954 | Seelig | 150/109 |
| 4,023,842 | A * | 5/1977 | Harvey | 248/99 |
| 4,604,770 | A * | 8/1986 | Lang | 16/363 |
| 5,242,160 | A | 9/1993 | Girard | |
| 5,451,107 | A * | 9/1995 | Ricker | 383/10 |
| 5,927,856 | A * | 7/1999 | Hung | 383/34 |
| 5,947,388 | A * | 9/1999 | Woodruff | 239/532 |
| 5,951,075 | A | 9/1999 | Green | |
| 6,174,848 | B1 * | 1/2001 | Dawson et al. | 510/297 |
| 6,312,343 | B1 | 11/2001 | Cho | |
| 6,386,414 | B1 | 5/2002 | Kilduff | |
| 2002/0139826 | A1 * | 10/2002 | Matthews | 224/607 |
| 2005/0011997 | A1 * | 1/2005 | Kalal | 248/99 |
| 2007/0053616 | A1 * | 3/2007 | Plouff | 383/22 |
| 2012/0061182 | A1 * | 3/2012 | Grimes | 182/194 |

* cited by examiner

*Primary Examiner* — Justin Larson

*Assistant Examiner* — Phillip Schmidt

(74) *Attorney, Agent, or Firm* — Daniel Boudwin; Global Intellectual Property Agency LLC

(57) ABSTRACT

A sports ball collection, transport and combination sports goal device is provided, comprising a set of hingedly attached frame members and an internal netted bag attached thereto. The frames are rounded sections of tubular material that are connected at their terminal ends at two hinge devices. The hinges allow the rounded frame sections to be opened and closed with respect to one another, providing access to the internal netting or closure thereof. In an open configuration, the frames provide a structure to hold the netted bag in an open position, wherein balls may easily be placed into the bag. In a closed position, the frame members mate together to form a closed bag and handled device for improved carrying and transport of the device and sports ball contained therein. In an alternate configuration, the frames may be positioned to act as a sports goal for recreational purposes, or to facilitate entry of sports balls within the bag cavity.

15 Claims, 5 Drawing Sheets

SPORTS EQUIPMENT COLLECTION AND TRANSPORT DEVICE

BACKGROUND OF THE INVENTION

1. Field of the Invention

The present invention relates to sports equipment containers and collection devices. More specifically, the present invention pertains to a combination sports ball carrying device, sports net and storage device that improves collection time of a particular sports ball and handling of a loaded device thereafter.

2. Description of the Prior Art

Practicing or training activities related to sports games that require a ball to conduct the game benefit when a plurality of balls is available for use. Availability of more than one ball reduces down time for individuals engaging in the activity. This is particularly true for team sports, wherein several individuals come together to practice their sport. The practice is best conducted with several balls, wherein each player is given ample contact time with the ball or interaction therewith to facilitate a comfort level, association and muscle memory when handling the ball during a sports game. The use of several available balls is true for practicing sports such as soccer, football, basketball, baseball, tennis, and any other sports activity that involves a ball to play.

Collection of such balls after a practice has ended is generally a tedious task, particularly for exhausted players, in environments of high heat or for those few individuals made responsible for collecting all of the provided balls without help from the rest of the participants. This task is made tedious specifically because of the structure of devices traditionally utilized for the collection and containment of such sports balls. Traditional ball bags incorporate a netted bag with a drawstring closure. These devices are formless and flexible, and offer no structure to aid in the process of loading the bag with the balls. The opening of the bag is unsupported and therefore requires two hands to spread the mouth of the opening to accommodate the diameter of the sports ball. Loading such devices is difficult with only one participant, as the ball must be handled in conjunction with the opening of the bag, which is not easily opened with a single hand.

Solutions this common problem have been to resort to shoveling the balls into an opened bag while supporting its opening using one hand and a foot to pin the base of the opening into a stable position against the ground. Alternatively, two individuals may be utilized to complete this task, one in which supports the bag opening while the second retrieves and places the balls into the bag opening. Both of these methods are not convenient or ideal for the given task. A device is required that solves these common drawbacks in the art and in the sports ball bag segment.

The present invention provides an improved sports ball collection and transport device that comprises a frame structure to support the opening of a netted bag. The netted bag contains the sports balls within the frame, while the frame provides a structure to support the bag in an open position and likewise in a closed position. The frame further provides a structure that hingeably forms a handle device for which a practitioner may easily carry and transport the device and any balls carried therein. It fulfills a long-felt need within the art and area of sports ball collection and transport.

Several devices have been disclosed in the prior art for facilitating the collection of sports balls and for improved containment thereof. These devices have drawbacks inherent in their design or flaws in their approach that limit their usefulness when compared to the structure and operation of the present invention. While they are independently novel, perform a given task or fulfill a given requirement, they do not describe the structure or spirit of the present invention.

Such devices include U.S. Pat. No. 6,386,414 to Kilduff, wherein a sport equipment bag is described having an outer, water-resistant shell and ventilation assemblies situated about its exterior for promoting free circulation of air through the bag. The ventilation assemblies include an opening formed into the outer shell that is covered by a mesh lining and a zippered flap. While the Kilduff device provides a large bag adapted for carrying sports equipment, its construction does not describe the present invention. Likewise, its ability to quickly load sports balls and other equipment from a working position into a stored position is limited by the user's ability to manually place each item into the bag interior. The bag further lacks the ability to function as a sports net, which is a configuration supported by the present invention.

U.S. Pat. No. 5,951,075 to Green is another device in which an apparatus for picking up, transporting and storing sports balls is disclosed that comprises two opposing planes separated by tension elements. The two planes are forced downward onto a sports ball, thereby stretching the tension elements to allow the planes to surround and grasp the ball. The pressure of the ball places the tension element under strain, which compresses the two planes against the ball and holds it in place. The planes are sufficient length to accommodate a plurality of balls using the same technique of picking up and storing each ball. This device is best suited for picking up ball individually on a playing field for storage and transport. Although for a similar purpose, the structure of the device is not representative of the present invention. Further, the Green device is not adapted to act as a sports goal when not in use as a ball container, and the mode of loading and carrying the Green device differs from the present invention.

U.S. Pat. No. 5,242,160 to Girard describes a portable backstop device with an upstanding, inverted and U-shaped frame with support legs and a base. The device functions as a rebound device or backstop protection device for sports involving balls or projectiles. Its construction allows for the rapid collection of sports balls and containment thereof, but it is not adapted for use as a ball bag or sports equipment carrier. This device employs a frame with a mounted net therearound, but lacks the novel features provided in the present invention, namely the combination of uses. The present invention provides a dual purpose device that can function as a ball collector, sports goal and sports ball transport container.

Finally, U.S. Pat. No. 6,312,343 to Cho describes a portable net device for stopping the flight of sports balls and other projectiles, comprising a coiled main member and a base member forming two closed loops and a central region of meshed netting. The coiled member allows improved portability of the device, while its intent is similar to the Girard patent in which the netting provides a backstop or net for shooting a projectile thereinto. The Cho patent lacks the ability to function as a multipurpose device, while the present invention provides a similar capability as the Cho patent while adding the ability to transport and store a plurality of sports balls in an easily-carried device. The present invention may serve as a back stop or goal device, but is adapted to form its frame together to form a handle, while the netting forms a closed basket around the sports balls within the frame members.

The present invention provides a new and unique device that improves current methods for collecting sports balls after a practice or training session. A plurality of balls may be placed within a meshed bag that is attached to two hingedly attached and semi-circular frame members. The frame members support the bag opening and allow closure thereof, providing a user with an easily graspable handle for carrying the device and its loaded contents. A shoulder strap is also provided for improved convenience and carrying ability. The frames can be hingedly rotated to any angle with respect to one another, allowing different sized opening for the bag or uses for the device in practice. Its structure and design elements substantially diverge from the prior art, and consequently it is clear that there is a need in the art for an improvement to existing sports ball collection and carrying devices. In this regard the instant invention substantially fulfills these needs.

SUMMARY OF THE INVENTION

In view of the foregoing disadvantages inherent in the known types of sports ball collection and carrying devices now present in the prior art, the present invention provides a new sports ball collection and carrying device wherein the same can be utilized for providing convenience for the user when independently filling a netted bag with a plurality of sports balls.

It is therefore an object of the present invention to provide a new and improved sports ball collection and carrying device that has all of the advantages of the prior art and none of the disadvantages.

Another object of the present invention to provide a supported bag opening for the collection of sports balls, and one that can be utilized by a single individual with improved ease and efficiency.

Another object of the present invention is to provide a ball collection device that comprises a rounded frame structure that allows modular positioning of the bag opening, to facilitate filling the bag, close the bag and to also offer a device that can function as a small sports goal if desired.

Another object of the present invention is to provide a frame structure that is hingeably constructed using a plurality of hinges that allow positioning and closure of the device in use.

Another object of the present invention is to provide a device that is easily handled prior to and after sports balls have been loaded therein, allowing a user of any size or stature to handle the device with ease.

Yet another object of the present invention is to provide a new collection and transport device that can accommodate any sports ball in varying numbers. The size of the frame, along with the density of the netting is modular to accommodate sport balls of varying diameter and geometry.

A final object of the present invention is to provide sports ball collection and carry device that is easily and inexpensively manufactured.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
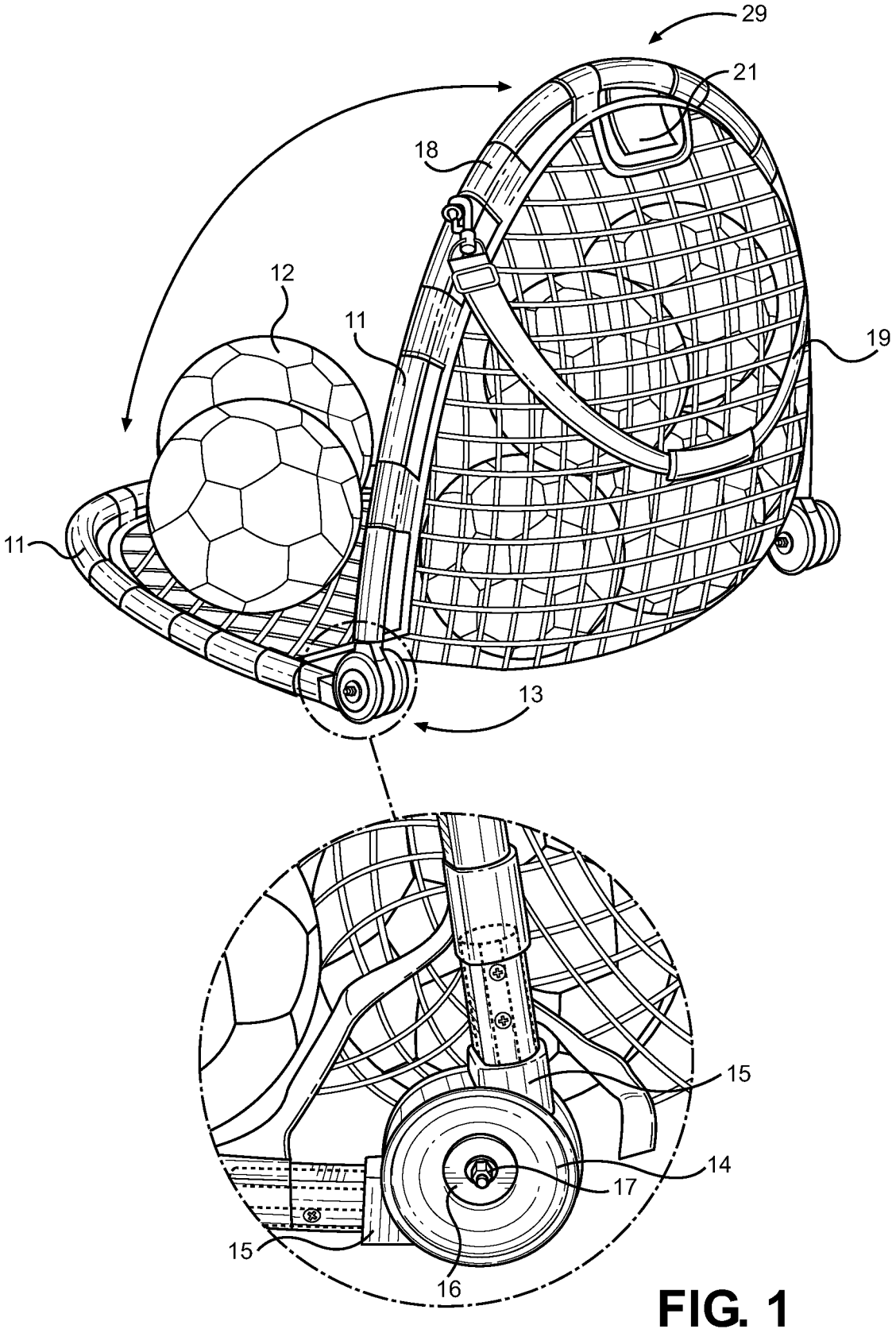
FIG. 1 shows a perspective view of a preferred embodiment of the present invention in a working position, along with a close-up view of the hinge device that supports the frame positioning.

Referring now to FIG. 1, there is shown a perspective view of a preferred embodiment of the present invention in a working position. Two rounded frame members 11 attach at their terminal ends to a hinge device 13. The hinge device allows the two frame members 11 to operate in a clamshell motion, wherein the frames 11 may be rotated with respect to an axis defined by a line intersecting the terminal ends of each frame. The rotation of the frames allows the device to open or close the assembly as desired, or to secure a first frame member 11 at a desired angle with respect to the second. Attached along the length of the frames 11 are netting attachment loops 18 that secure the mesh netting to the frames 11. These securement loops 18 may attach at discrete locations along the frames, or alternatively span the entire length of each. A flap 21 is provided along the upper apex of a first frame 11 to secure both frames together in a closed position. The flap 21 is adapted to wrap around the outer surface of both frames 11 and secure the two together when the frames 11 are in a closed position, forming a handle region 29 for the user to grasp while transported the device. This area also includes a cut-out in the meshed netting to allow placement of the user's fingers while grasping the handle 29.

A close-up view of the preferred hinge device 13 is shown in FIG. 1. The preferred mechanism for supporting the frames 11 in a static position when in use includes two circular disks 14 secured together using a lock nut 17 and a washer 16. The disks are mated together using friction provided by the lock nut 17 clamping pressure, which allows the device to maintain a static position during operation, while also allowing for rotation of the two disks 14 with respect to each other when opening and closing the frames 11. The outside washer is preferably a Mylar material and distributes the clamping pressure of the lock nut 14 across the contact interface of the two disks 14. A lubricant such as white grease or similar product may be supplied along the contact interface between the disks to facilitate smooth rotation. Protruding from each disk 14 is a stem portion 15 that concentrically mates to an associated frame member 11. The stem 15 slides into the frame member 11 interior cross section and is fastened into place, supplying connection between the frames 11 and the disks 14.

The preferred cross section of the frames is a truncated semi-circle that forms a flat inner portion and a rounded outer portion. The flat portion of each frame 11 is adapted to make flush contact with one another when in a closed position. In this position, the two rounded outer portions form two halves of a closed circle for which the user to grasp together as a handle 29. The flap 21 can be wrapped around the perimeter of the closed circle to secure the two frame sections together. To aid carrying the device, a carrying harness 19 is provided for the user to shoulder-carry the device in conjunction with the handle.

In the position shown in FIG. 1, the present invention functions as a device that accelerates ball 12 collection and placement into the mesh netting. Once all balls are collected or the carrying capacity of the device has been reached, the frames are rotated together to form a closed netting around the balls 12, providing containment thereof. In an alternate function, the device may also operate as a sports goal in this configuration for users to throw, shoot, hit or kick balls into for entertainment or for sport purposes. The hinge 13 maintains the position of the frames 11 at a desired angle, which function as goal posts in this configuration.

Figure 2:
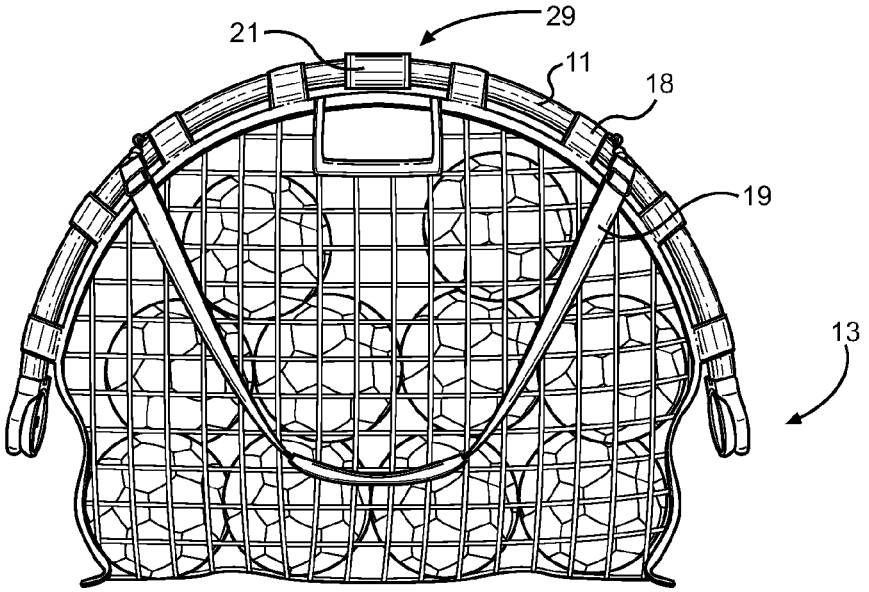
FIG. 2 shows a front view of a preferred embodiment of the present invention, wherein the device is situated in a closed position and containing a plurality of sports balls.

Referring now to FIG. 2, there is shown a front view of a preferred embodiment of the present invention, wherein the device is situated in a closed position. The meshed netting provides a containment bag for a plurality of sports balls, while the frames 11 are aligned in a closed position to secure the opening of the bag and prevent balls from slipping out. The two flat portions of the frames mate together to form a circular handle region 29 while the flap 21 ties the handle region together. In this orientation, a user can grasp the handle 29 and carry the loaded device to his or her side. The carrying harness 19 is also available for supporting the assembly on the user's shoulder.

Figure 3:
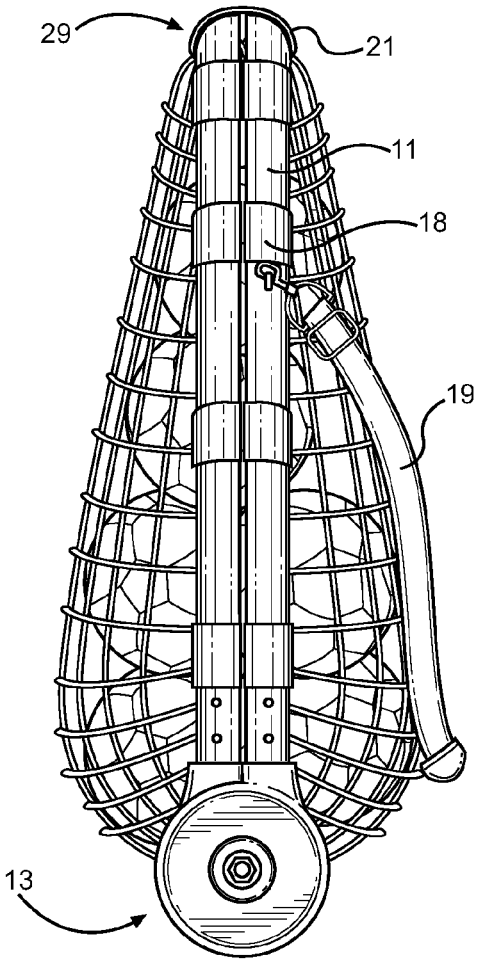
FIG. 3 shows a side view of a preferred embodiment of the present invention, wherein the device is similarly in a closed position and containing a plurality of sports balls.

Referring now to FIG. 3, there is shown a side view of a preferred embodiment of the present invention, wherein the device is situated in closed position and containing a plurality of sports balls. In this view, the formation of the handle 29 is clearly shown, as the profile of the two rounded frames mate flushly together to form a circular handle for which the user to grasp. The meshed bag is adapted to accept a plurality of sports balls and expand accordingly. The size and contour of the bag may vary depending upon application and the chosen sports ball to contain therein.

Figure 4:
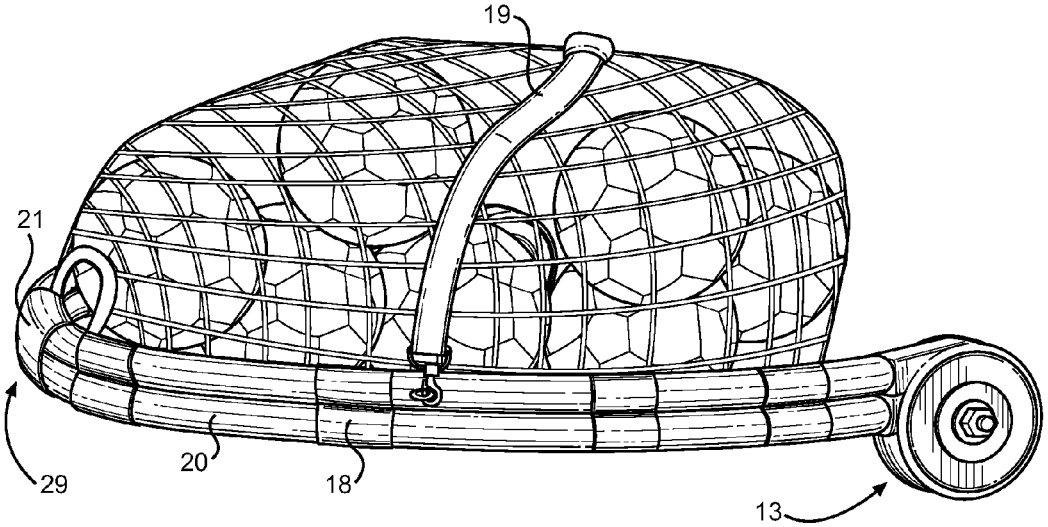
FIG. 4 shows a side view of an alternate embodiment of the present invention in a stowed position, wherein the frame members comprise a cylindrical cross-section.

Referring now to FIG. 4, there is shown a side view of the present invention in a stowed position, wherein an alternate embodiment of the frame members 11 is shown. In this embodiment, each frame 11 comprises a cylindrical cross-section, as opposed to two half-cylinders with a flat portion that forms a cylindrical handle 29. In the configuration as shown in FIG. 4, the two cylindrical frames 11 form a larger, dual cylinder handle that is secured together using a provided flap 21. While less ideal than the preferred embodiment, this configuration is contemplated for ease of manufacturing.

Figure 5:
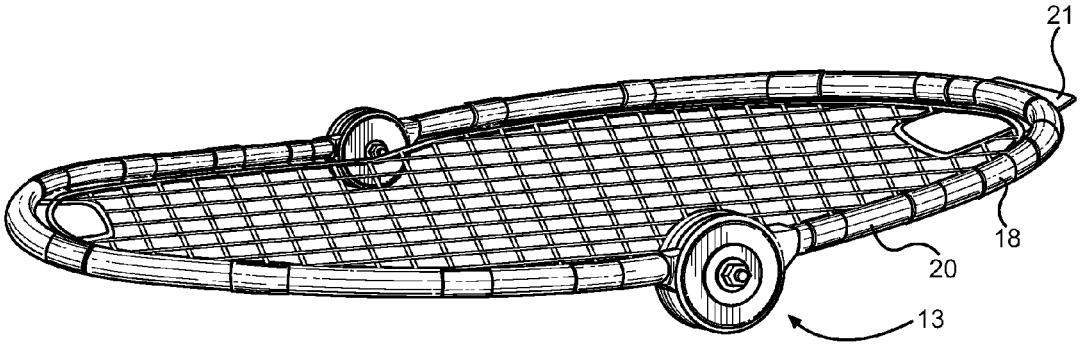
FIG. 5 shows a side view of the cylindrical frame member embodiment of the present invention in an open position.

Referring now to FIG. 5, there is shown another view of the alternate embodiment of the frames 11. In the configuration as shown in this figure, the frames are spread completely open, forming a flat surface for which to lay sports balls onto and then rotate the frames together. Upon rotation, the netting envelopes the balls positioned on the device and secures the same within the device interior.

Figure 6:
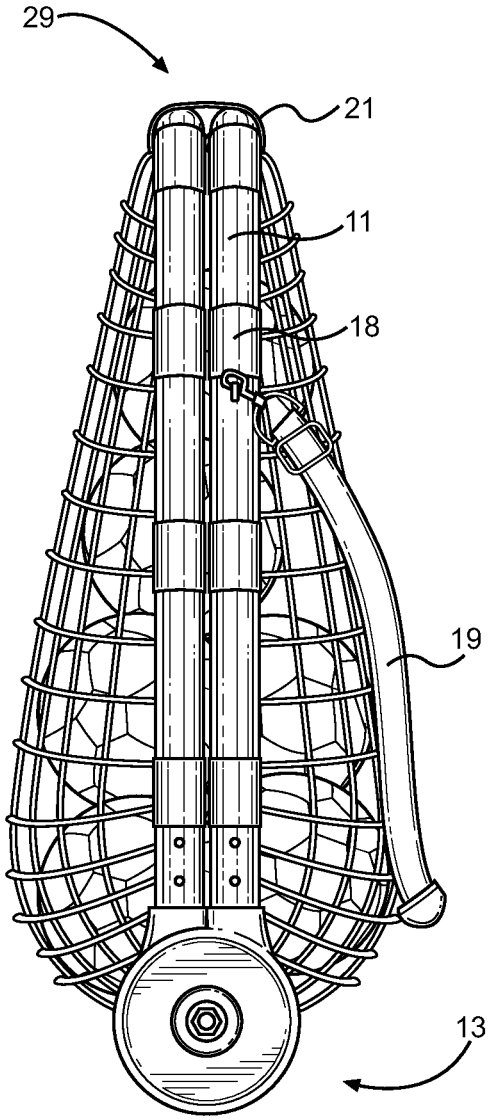
FIG. 6 shows another side view of the cylindrical frame member embodiment of the present invention in a closed position.

Referring now to FIG. 6, there is shown another side view of the cylindrical frame member embodiment of the present invention in a closed position. This view highlights the positioning of the handle 29 using cylindrical frame members 11. The flap 21 wraps around the two cylinders to secure the two together, forming a secured grasping surface, with the carrying harness 19 providing additional convenience for supported the carried load.

Figure 7:
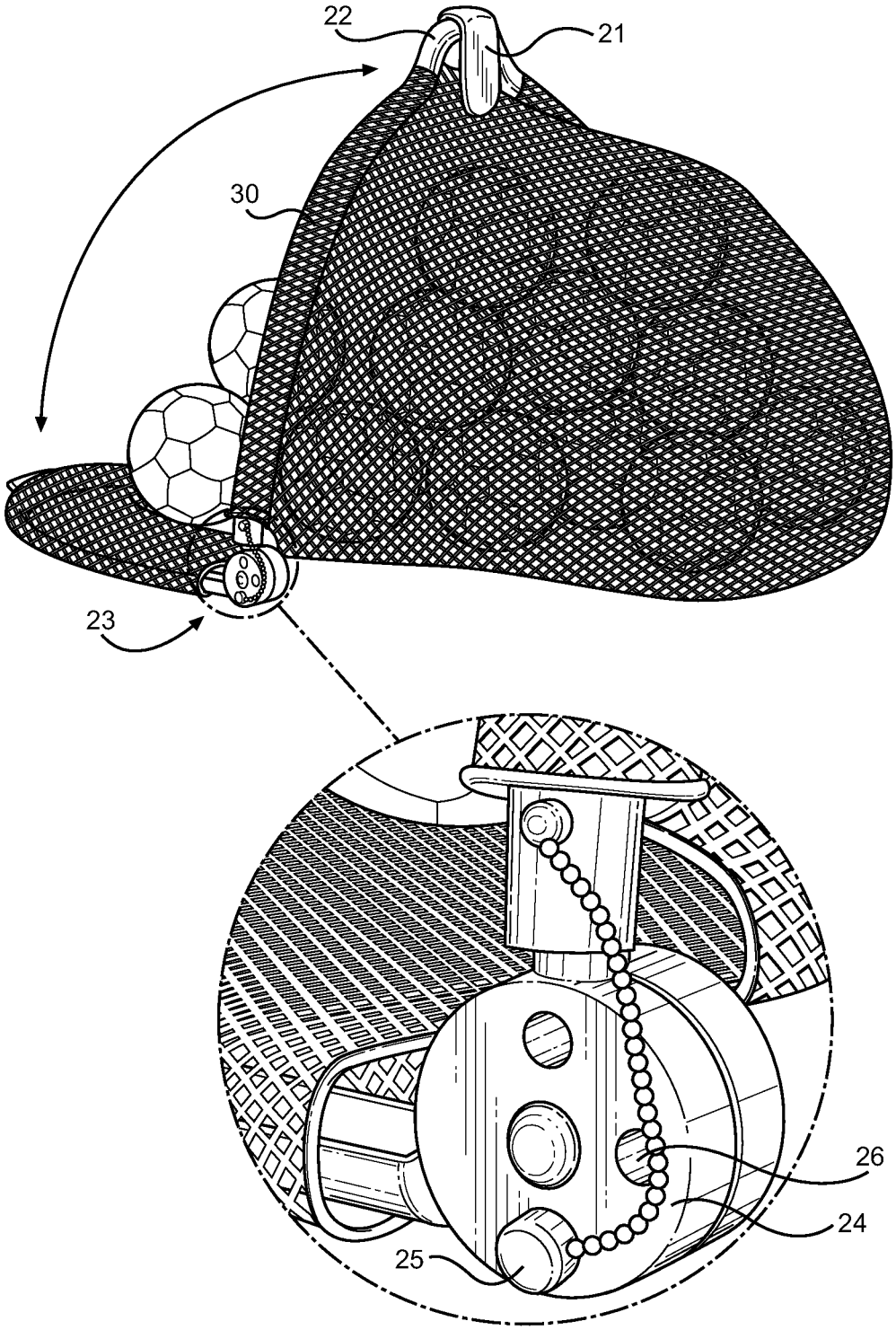
FIG. 7 shows a perspective view of yet another embodiment of the present invention in a working position, wherein the density of the bag mesh is finer and a locking hinge mechanism is provided.

Referring now to FIG. 7, there is shown a perspective view of an alternative embodiment of the present invention, along with a close-up view of an alternate embodiment of the hinge mechanism 23. In this embodiment, the style and density of the mesh netting is altered to accommodate smaller sports balls. The mode in which the netting attaches to the frame members 30 is also altered, wherein the netting wraps around the frames 30 to provide continuous contact between the two along the length of the frames 30. The frames 30 themselves are also modified. This embodiment of the frames 30 incorporates a bump-out section of the rounded frames. The bump-out provides an integrated handle that is raised above the normal path of the rounded frame, allowing greater access to and grasping of the handles 22. Similar to the aforementioned embodiments of the frames, the cross section of the frames may include two half-circular sections that abut against one another along their flat portions or two fully circular sections that are placed coincident to each other. In either design, a flap 21 is provided to secure the two handle 22 portions together for the user to grasp.

Also shown in FIG. 7 is a close-up view of an embodiment of the hinge mechanism 23 that incorporates a locking pin mechanism. In this embodiment, two circular disks 24 with associated stem portions are connected by a central axle pin that allows rotation of the two with respect to one another. A plurality of pinhole locations 26 are provided on each disk 24 and extended laterally through each disk section. The frames 30 can be rotated to align two pinholes 26 of the two disks, thereafter a locking pin 25 may be inserted therethrough to lock the two disks into position. The stems of each disk are inserted into the terminal ends of corresponding frame members to allow rotation of the frames about the central axle pins. This mechanism allows discrete positioning of the hinge 23 at predefined locations defined by the location of the provided pinholes 26. The frames 30 are locked into place until the pin 25 is subsequently removed, allowing free rotation of the disks 24 and associated frame members attached thereto. A chain is provided to prevent the pin 25 from being misplaced or lost during use.

The present invention may be used in any particular embodiment or stated configuration to collect and carry a plurality of sport balls using a single practitioner. The ability to collect loose balls is improved and the efficiency in which they are placed into the netted bag is likewise improved over devices currently available and described in the art. The structure of the device provides a useful tool for coaches, athletic trainers and gym teachers to gather sports equipment after an activity wherein several articles or sports balls are required. The balls can be quickly loaded into the device, wrapped within the netting and enclosed by rotating the frame member together. After collection, the assembly is easily carried using the built-in handle along the conjoined frames, along with the supplied carrying harness, allowing improved transport for individuals of all stature and strength. Overall, the present invention is a marked advancement in the art of sports equipment bags and collection devices. Its structure is sufficiently described and distinguished from comparable devices, and therefore fulfills a long-felt need in the art for collecting, carrying and storing sports balls.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sports ball collection and carrying device, comprising:

two rounded, semi-circular frame members with a first and second terminal end;

said first terminal ends of said frame members affixed to a first hinge mechanism, and said second terminal ends affixed to a second hinge to form a hingeable, clamshell frame;

wherein said first hinge and said second hinge are adapted to secure said first frame member at any of a variety of angles with respect to said second frame member;

a meshed netting attached to said frame members forming a bag interior to said frame members;

a handle region along said frame members that forms when said frames are placed in a closed position;

wherein the cross section of said two frame members is a truncated semi-circle, such that said cross section of said two frame members forms a flat portion and a rounded portion, wherein said two frame members are adapted to mate together to form a circular handle.

2. A device as in claim 1, wherein said handle region is located at an apex of said rounded frame members.

3. A device as in claim 1, further comprising a flap that secures said handle regions of said frames together when said frames are mated together in a closed position.

4. A device as in claim 1, further comprising a carrying harness attached to a first frame member for shoulder-carrying said device in a closed position.

5. A device as in claim 1, wherein said handle region further comprises a bump-out region comprising a continuous portion of a frame member for improved grasping of said handle.

6. A device as in claim 1, wherein said hinge mechanism comprises:

a first and second circular disk mated and clamped together using a lock nut and two exterior washers;

said circular disks further comprise protruding stem portions that are adapted to slide into said first and second terminal ends of said frame members and are fastened thereto.

7. A device as in claim 1, wherein said hinge mechanism comprises:

a first and second circular disk, an elongated locking pin and a plurality of pinholes distributed through said circular disks;

said disks mounted to a central axle pin to allow independent rotation of said disks;

said locking pin being slideable through aligned pinholes of said first and second circular disk to lock said disks into a static position;

said circular disks further comprise protruding stem portions that are adapted to slide into said first and second terminal ends of said frame members and are fastened thereto.

8. A device as in claim 1, wherein said mesh netting attaches along said frame members using netting attachment loops at discrete locations.

9. A device as in claim 1, wherein said mesh netting is wrapped around said frame members to form a continuous connection along said frame length.

10. A device as in claim 1, wherein said mesh netting provides a hole in proximity to said handle region to facilitate room for a user's hands around said handle.

11. A sports ball collection and carrying device, comprising:

two rounded, semi-circular frame members with a first and second terminal end;

said first terminal ends of said frame members affixed to a first hinge mechanism, and said second terminal ends affixed to a second hinge to form a hingeable, clamshell frame;

wherein said first hinge and said second hinge are adapted to secure said first frame member at any of a variety of angles with respect to said second frame member;

a meshed netting attached to said frame members forming a bag interior to said frame members;

a handle region along said frame members that forms when said frames are placed in a closed position, said handle region being located at an apex of said rounded frame members;

a flap that secures said handle regions of said frames together when said frames are mated together in a closed position;

wherein the cross section of said two frame members is a truncated semi-circle, such that said cross section forms a flat portion and a rounded portion, wherein said two frame members are adapted to mate together to form a circular handle;

a carrying harness attached to a first frame member for shoulder-carrying said device in a closed position.

12. A device as in claim 11, wherein said hinge mechanism comprises:

a first and second circular disk mated and clamped together using a lock nut and two exterior washers;

said circular disks further comprise protruding stem portions that are adapted to slide into said first and second terminal ends of said frame members and are fastened thereto.

13. A device as in claim 11, wherein said hinge mechanism comprises:

a first and second circular disk, an elongated locking pin and a plurality of pinholes distributed through said circular disks;

said disks mounted to a central axle pin to allow independent rotation of said disks;

said locking pin being slideable through aligned pinholes of said first and second circular disk to lock said disks into a static position;

said circular disks further comprise protruding stem portions that are adapted to slide into said frame member terminations and are fastened thereto.

14. A device as in claim 11, wherein said mesh netting attaches along said frame members using netting attachment loops at discrete locations.

15. A device as in claim 11, wherein said mesh netting provides a hole in proximity to said handle region to facilitate room for a user's hands around said handle.

* * * * *